United States Patent [19]

Forster et al.

[11] 4,142,452

[45] Mar. 6, 1979

[54] AXIAL-PISTON MACHINE WITH INCLINABLE CONTROL SURFACE

[75] Inventors: Franz Forster, Mühlbach; Walter Heyl, Johannesberg, both of Fed. Rep. of Germany

[73] Assignee: Linde Aktiengesellschaft, Wiesbaden, Fed. Rep. of Germany

[21] Appl. No.: 795,084

[22] Filed: May 9, 1977

[30] Foreign Application Priority Data

May 10, 1976 [DE] Fed. Rep. of Germany ..... 2620523

[51] Int. Cl.[2] ..... F01B 13/04

[52] U.S. Cl. ..... 91/506

[58] Field of Search ..... 91/505, 506; 417/218, 417/222, 238; 92/12.1, 12.2

[56] References Cited

U.S. PATENT DOCUMENTS

| | | | |
|---|---|---|---|
| 2,956,508 | 10/1960 | Wahlmark | 417/218 |
| 3,063,381 | 11/1962 | Budzich | 417/222 |
| 3,257,959 | 6/1966 | Budzich | 417/222 |
| 3,366,968 | 1/1968 | Isemann | 91/506 |
| 3,426,686 | 2/1969 | Anderson | 417/218 |
| 3,643,550 | 2/1972 | Lease | 91/506 |
| 3,681,919 | 8/1972 | Forster | 417/238 |
| 3,682,044 | 8/1972 | Ankeny et al. | 91/506 |
| 4,026,195 | 5/1977 | Forster | 91/506 |

FOREIGN PATENT DOCUMENTS

| | | | |
|---|---|---|---|
| 812927 | 11/1955 | United Kingdom | 91/506 |
| 994666 | 6/1965 | United Kingdom | 91/506 |

*Primary Examiner*—William L. Freeh

*Attorney, Agent, or Firm*—Karl F. Ross

[57] ABSTRACT

An axial-piston machine of the type in which a prismatic housing, usually of rectangular or square cross section, receives a rotatable cylinder drum, the pistons of which bear against an inclinable control surface. The control surface is formed on a rocker or tilting box which can be tilted about an axis perpendicular to the axis of rotation of the drum. The rocker-setting elements are disposed between the housing bottom and the reaction surface of the rocker (against which the pistons bear), at the corners of a rectangle which closely circumscribes the orbit of the pistons. Consequently, the presence of the rocker-displacing means does not increase the dimensions of the machine over those necessary for a fixed control surface machine.

15 Claims, 13 Drawing Figures

AXIAL-PISTON MACHINE WITH INCLINABLE CONTROL SURFACE

FIELD OF THE INVENTION

The present invention relates to an axial-piston machine of the inclined-disk or swash-plate type in which a drum is formed with a plurality of cylinders each piston of which bears against a control surface which lies in a plane tiltable about an axis perpendicular to the axis of rotation of the drum.

BACKGROUND OF THE INVENTION

Axial-piston machines of the aforedescribed type are known in the art and can be used as hydrostatic motors or hydrostatic pumps, most often as variable-displacement pumps, the displacement being a function of the degree of tilt of the inclined disk (swash plate) or control surface. When in operation, the cylinder drum of the pump is rotated about its axis, e.g., by a shaft journaled in the housing, which can have a prismatic configuration, e.g., a square or rectangular cross section, so that the pistons of the drum are caused to move inwardly and outwardly as they orbit against the inclined plane. Means is customarily provided to displace the control surface about its pivot axis.

In German open specification (Offenlegungsschrift) DT-OS No. 2,240,579, the control surface is formed as a flat face of a rocker which can be tilted about an axis parallel to the plane of the surface by a setting piston. In this construction, a setting cylinder is provided to either side of the pivot axis and the two setting cylinders lie in a common plane perpendicular to the pivot axis of the rocker, the setting pistons acting upon projections from the rocker.

This construction in which the longitudinal median plane through the cylinder drum coincides with the plane of the setting cylinders, requires considerable space and increases the dimensions of the machine to accommodate the setting cylinders over the size which would be required simply to house the drum and rockers absent these cylinders. As a consequence, the machine is heavy and the cost of fabrication, in terms of additional material and the like, is high.

It has also been proposed (see U.S. Pat. No. 3,779,137), to provide an axial-piston machine in which the setting cylinders can have their axes parallel to the axis of rotation of the setting drum. Another arrangement has the disadvantage that an articulated linkage is required between the piston of the setting cylinder and the rocker. Once again, the housing must be enlarged over the minimum prismatic housing accommodating the drum, to receive the actuating cylinders, their pistons and the respective linkages, if any.

OBJECTS OF THE INVENTION

It is the principal object of the present invention to provide an axial-piston machine which is free from the disadvantages set forth above and affords effective control of the rocker in a minimum of space.

Another object of the invention is to provide an axial-piston machine having a tilting box or rocker and an actuator therefor which functions more reliably than earlier systems.

Still another object of the invention is to minimize the space required to accommodate an actuator for the tilting box or rocker of an axial-piston motor or pump.

SUMMARY OF THE INVENTION

These objects and others which will become more readily apparent hereinafter are attained, in accordance with the present invention, in an axial-piston machine which comprises a prismatic housing, generally of square cross section, a cylinder drum rotatable about an axis and a rocker or tilting box forming a planar control surface or swash plate against which the pistons of the drum bear.

According to the present invention, the rocker or tilting-box actuator comprises four setting elements disposed at the corners of a rectangle (i.e., a square) and engaging the four corners of the rocker within the prismatic outline of the housing but, advantageously, with a radial spacing from the axis of rotation of the drum which is not substantiallly greater than the radius of the drum but is less than half the length of the diagonal through the housing. Thus, if the housing is prismatic and the drum is cylindrical, the rocker surface engaged by the pistons of the drum may also be rectangular so that the aforementioned corners of the rocker lie radially outwardly of the orbit of the pistons of the drum.

It has been found that this arrangement of the setting elements at the four corners of the rocker, preferably at the vertices of a square as seen in section through the axis of rotation of the drum and closely circumscribing same, is highly advantageous. In this case, the setting elements can be disposed in the housing without increasing the dimensions thereof over those of a machine in which the swash plate or control surface is not tiltable with respect to the cylinder drum axis. Because the four setting elements engage the four corners of the rocker in force-transmitting relation and symmetrically on opposite sides of a median plane through the rocker and perpendicular to the tilting axis, the resultant of the setting force is applied along the median axis of the rocker bearing and no canting moment is applied to the rocker.

According to a feature of the invention, all four of the setting elements are setting cylinders in each of which a piston is displaceable. Preferably if a cylinder receives a spring which bears upon the piston in the direction of the rocker and hence is effective parallel to the application of fluid pressure to the setting cylinder. This arrangement has been found to be most effective for servovalve control of the tilt of the rocker and hydraulic fluid can be admitted to the cylinders either through the rocker or through the housing.

Alternatively, two of the setting elements on one side of the tilting axis of the rocker can be hydraulic cylinders of the type described while the other pair of units can be control springs which bias the rocker into one extreme tilted position. The hydraulic fluid feed to the cylinders can thus be a function of the main fluid pressure so that a power control is provided automatically, i.e., the rocker is tilted to a greater or lesser extent depending upon the pressure prevailing in the machine.

Since, upon tilting of the rocker, the point of attack of the setting element upon the rocker describes an arcuate path, while the pistons of the setting units generally are received within cylinders of a rectilinear configuration, it is advantageous to compensate for the different movements in the following manner:

(a) the setting cylinders are articulated or pivotally mounted; or (b) the setting cylinders are rigidly fixed in the housing while the pistons have spheroidal portions sealingly cooperating with the rectilinear walls of the cylinders to permit tilting of the pistons relative to the cylinder axis; or (c) the cylinder is fixed in the housing and the pistons can undergo only rectilinear movement within their cylinders. In the last-mentioned case, a slide shoe or other slide device is provided between each setting piston and the rocker so that the end of the setting piston can shift with respect to the opposing surface of the rocker.

Best results have been obtained when the hydraulic fluid supply to the setting cylinders is effected through the rocker. In this case, the setting cylinder can be articulated to the rocker and can have the pistons engage the housing, or the piston can be provided with a passage communicating with a bore in the rocker and with the working chamber in the setting cylinder which is connected to the housing.

This has an advantage that the rocker can be provided directly with a follower-type control by, for example, disposing a slide valve along a flank of the rocker and moving the slide valve with respect to the ports in the lateral flank of the rocker. Alternatively, the ports of the rocker may move relative to the valve structure to open or close a fluid passage to or from the rocker and hence the setting cylinder. Since the setting pressure can be relatively small, the leakage losses are not significant and, even where they occur, do not involve any significant energy loss.

According to a particularly advantageous embodiment of the invention, each of the setting pistons has a ball head swingable in a spacer plate which is, in turn, connected to the inclinable control surface of the rocker. The setting cylinder can either be swingable in the housing or the piston can be provided with a spheroidal part enabling each piston to tilt in the respective cylinder. Since the ball seat for the head of the setting piston is not formed directly in the rocker but is constituted by the spacer plate, the structure can be made significantly less costly since machining a socket in the rocker directly is avoided, especially since the inclinable control surface of the rocker is generally hardened and superfinished.

The spacer plate permits bearing metal or like material to be used for the socket, which can consist of sintered steel particles, wear-resistant steels or the like. This reduces the cost of manufacture and permits replacement of a spacer plate when the latter wears out without a replacement of the entire rocker.

It should be apparent that this arrangement also has numerous other advantages. For example, if the dimensions of the rocker must be limited, the spacer plates can project beyond the edges of the rocker and thereby increase the distance between the point of attack of the setting cylinder upon the rocker and the cylinder-drum axis. When the ball socket is formed directly in the rocker, such outward spacing of the point of attack is limited by the boundaries of the rocker. Of course, the greater the distance between the point of attack and the tilting axis of the rocker, the greater is the lever arm effectiveness for tilting the rocker and the the smaller can be the setting piston diameter for application of a given torque thereto.

Furthermore, the spacer plate has the additional function that it can be used to hold the plate by which the heads of the working pistons are retained against the inclinable control surface, i.e., the plate which prevents the slide shoes of these pistons from withdrawing from the control surface. In this case, the thickness of the spacer plate must be reduced to the height of the slide shoes.

The system of the present invention can also be used for tilting the swingable housing of a drive flange machine, the cylinder being received in the tiltable housing and the piston rods of the cylinder bearing against a fixed portion thereof in which the drive flange is journaled.

BRIEF DESCRIPTION OF THE DRAWING

The above and other objects, features and advantages of the present invention will become more readily apparent from the following description, reference being made to the accompanying drawing in which:

FIG. 8 being a view taken along the line VIII — VIII of FIG. 7;

SPECIFIC DESCRIPTION

Figure 1:
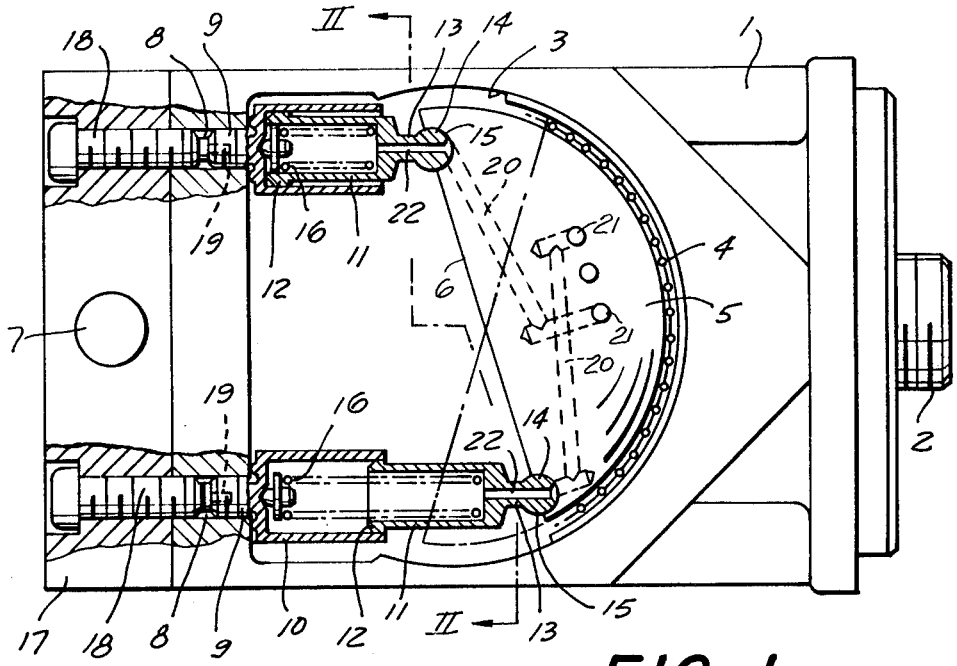
FIG. 1 is a side-elevational view, partly in section and omitting portions which are not material to the explanation of the present improvement, of an axial-piston machine according to the invention provided with fixed setting cylinders for displacing the rocker according to the present invention.

The axial-piston machine illustrated in FIG. 1 comprises a housing 1 in which the drive shaft 2 is journaled, the drive shaft being connected to a cylinder drum which has not been illustrated in this Figure. The housing 1 is provided with a cylindrical concave surface 3 whose axis lies perpendicular to the axis of shaft 2 and of the cylinder drum. Within this cylindrical concavity, a rocker 5 is tiltable by means of a bearing 4 in the form of a roller band, i.e., a cage provided with roller bearings as can be seen diagrammatically in FIG. 1. The left-hand face of the rocker 5 forms a control disk surface 6 against which the slide shoes of the pistons of the cylinder drum bear.

A passage 7 represents the hydraulic fluid connections to the cylinder drum, these connections being provided in the usual manner to supply hydraulic fluid to the cylinders of the drum and remove hydraulic fluid under pressure therefrom.

The housing 1 is also provided with two threaded bores 8 into each of which a threaded head 9 is screwed, each threaded head 9 forming part of a setting cylinder 10. The two bores and setting cylinders illustrated in FIG. 1 represent the oppositely effective setting cylinders on one side of the rocker. A second such set of setting cylinders is provided on the opposite side of the rocker so that the setting cylinders lie at the corners of a square as has been illustrated in FIG. 2.

In each of the setting cylinders 10, a setting piston 11 is shiftable, the free ends of the setting pistons 11 being each formed with a spheroidal portion 12 sealingly engaging the wall of the respective setting cylinder 10. Hence the pistons 11 can be tilted to a limited extent.

A neck 13 of each of the pistons 11 carries a ball head 14 which is received with freedom of pivotal movement in a ball seat 15 of the rocker 5. Within each setting cylinder 10 and each setting piston 11, a compression 16 is disposed to urge the piston in the direction of the rocker. The housing bottom 17 is held by four anchoring screws 18 against the housing 1. Each threaded head 9 is provided with a slot 19 adapted to accommodate a screw driver so that the respective cylinder 10 can be mounted in the threaded bores 8 into which the bolts 18 are also screwed. Alternatively, or in addition, the cylinders 10 can have hexagonal (nut-shaped) outer peripheries which can be gripped by a wrench and are held in position by housing plates 24 described below.

In the rocker 5, each of the ball sets 15 is connected via a passage 20 with a bore 21 which opens in an end face of the cylindrical segmental rocker 5 and serves to supply hydraulic fluid to and remove hydraulic fluid from the setting cylinders 10.

Against the lateral face of the rocker 5, a valve slider can lie to form a flat control valve therewith. The control valve has not been illustrated in these Figures although it may be similar to the arrangement illustrated in FIG. 13 and described hereinafter. For example, the lower bore 21 may be supplied with hydraulic fluid while the hydraulic fluid is released from the upper bore 21. In this case, the two upper cylinders 10 are supplied with fluid while fluid is discharged from the two lower cylinders and the rocker 5 is caused to rotate in the clockwise sense along the cylindrical seat 3. The rocker 5 can thus be shifted from its solid-line position as illustrated in FIG. 1 to the dot-dash-line position shown. The prestress of the springs 16 can be varied by screwing the heads 9 more or less deeply into the bores 8 and thereby shifting the cylinders 10 toward or away from the rocker 5.

Figure 2:
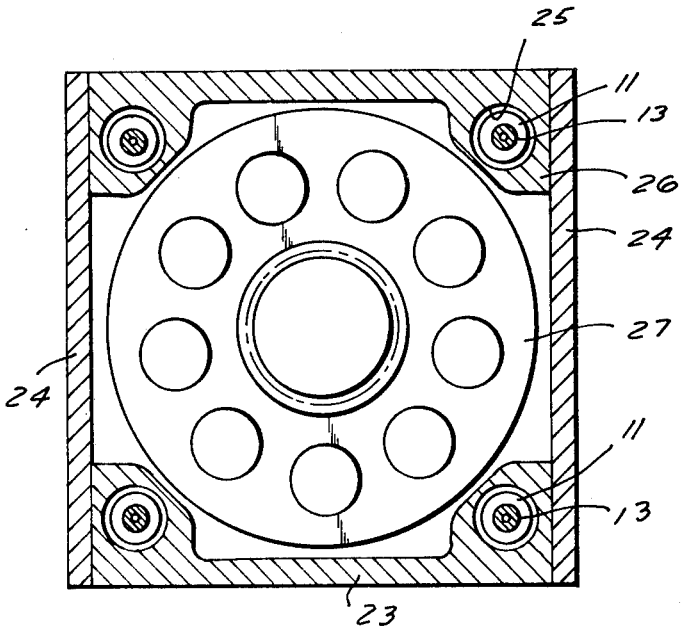
FIG. 2 is a section taken generally along the line II — II of FIG. 1 through a similarly constructed machine, the section plane II — II being generally perpendicular to the axis of rotation of the cylinder drum.

In the embodiment illustrated in FIG. 2, the setting cylinders, instead of being formed individually, are constituted as bores 25 in corresponding corner pieces 26 of walls 23 of the housing. The cylinders 25 receive pistons 11 with neck portions 13 as described in connection with FIG. 1. The housing is closed by a pair of cover plates 24. When the latter are used with the embodiment of FIG. 1, they can hold the hexagonal portions of the setting cylinders against rotation as has been described.

Since the machine is generally produced with a rectangular housing configuration, at least approximately, and the cover plates 24 are rectangular, the arrangement of the setting cylinders 25 in the four corners of the structure does not increase the size for a given diameter of the cylinder drum. Hence the size of the housing is generally determined by the diameter of the cylinder drum 27. The axes of the setting cylinders 25 thus lie at the corners of a square which circumscribes the cylinder drum. Naturally, when only two setting cylinders are provided at two of the vertices of a square, e.g., above and below the cylinder drum axis as shown in FIG. 1, the arrangement also does not increase the dimensions of the housing which again is determined by the rectangular configuration necessary to enclose the cylindrical drum.

Figure 3:
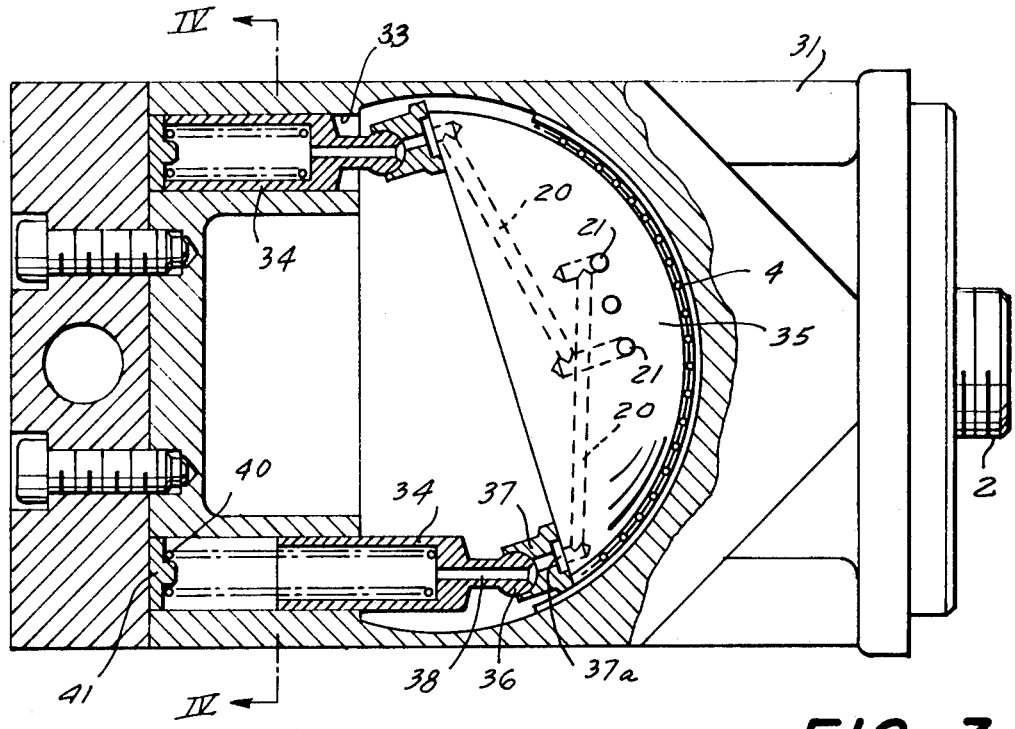
FIG. 3 is a view similar to FIG. 1 illustrating another embodiment of the invention in which the cylinders are formed in a housing portion surrounding the cylinder drum.
Figure 4:
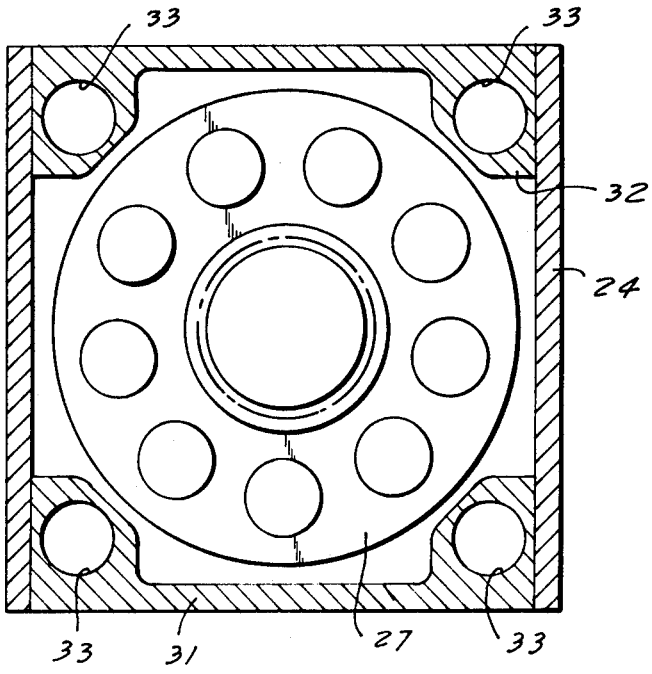
FIG. 4 is a section taken along the line IV — IV of FIG. 3 with the cylinder drum being shown diagrammatically in elevation and the pistons of the rocker-setting arrangement and of the cylinder drum omitted.

In the embodiment of FIGS. 3 and 4, the drive shaft 2 is journaled in the housing 31 and is connected with the cylinder drum 27. In the four corners of the housing 31, there are provided corner members 32 in which the setting cylinders 33 are formed. In each of the setting cylinders 33, a setting piston 34 is shiftable and is provided with a ball head 36 which is received in a sliding shoe 37 pressed against the flat surface 6 of the rocker 35, this surface also forming the inclined or inclinable plane against which the pistons of the cylinder drum bear. The rocker 35 corresponds to the rocker 5 with the sole difference that the rocker 35 is not formed directly with the ball seats 15 for the heads of the setting pistons. The supply of hydraulic fluid to the working compartment of the setting cylinders 33 is effected via the passages 21 and 20 as previously described via fluid cushion compartments **37*a* in the shoes 37 and bores 38 in the setting pistons 34. Within each of the setting pistons 34 a compression spring 40 is disposed which bears against a spring plate 41 centering the spring within the cylinder 33. The housing 31 is here also closed by cover plates 24. Here again the setting cylinders are disposed within the normal rectangular machine contour at the vertices of a square which generally circumscribes the orbit of the pistons of the axial-piston cylinder drum 27**.

Figure 5:
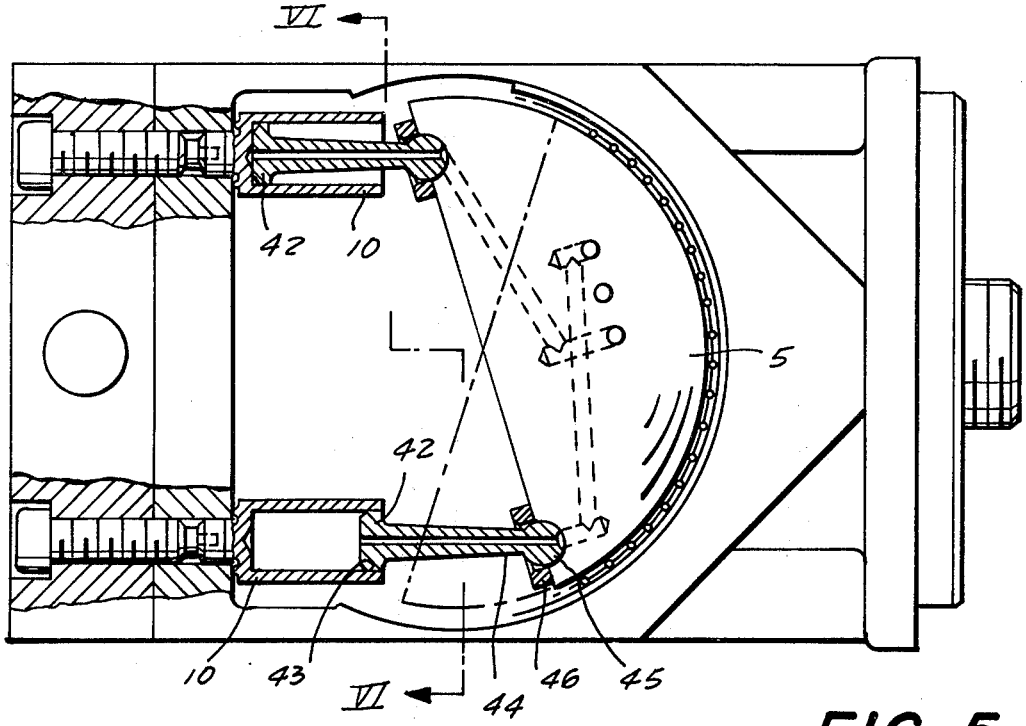
FIG. 5 is a view similar to FIG. 1 but illustrating another embodiment of the arrangement in which individual cylinders are provided for displacing the rocker.

The embodiment of FIG. 5 differs from that of FIG. 1 only in that the setting pistons 42 have a different configuration from that of the setting pistons 11. The setting pistons 42 are provided with generally spheroidal sealing portions 43 which permit slight tilting of the pistons 42 and sealingly engage the cylinders 10. These sealing portions 43 are connected by piston rods 44 with ball heads 45 which are pivotal within the ball seats 15 of the rocker 5. In this embodiment, compression springs bearing upon the pistons 42 are eliminated and the ball heads 45 are held against the rocker 45 by retaining plates 46 which can be bolted to the rocker.

Figure 6:
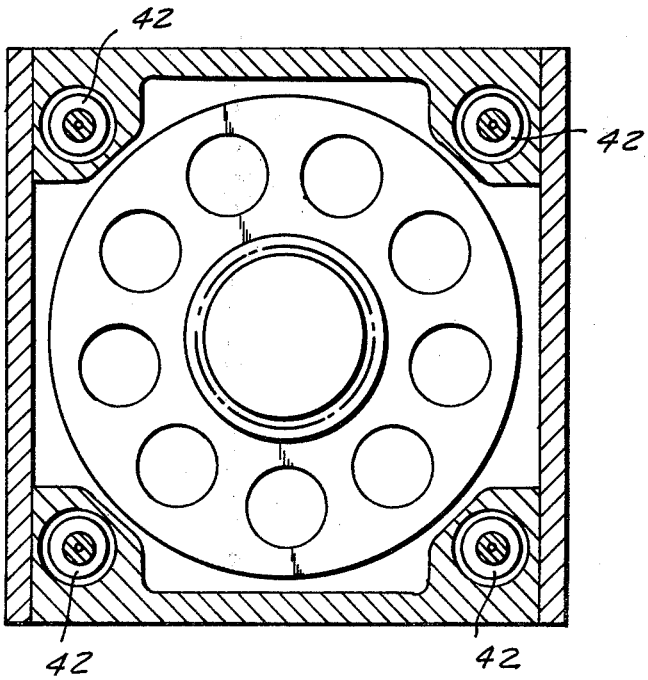
FIG. 6 is a section of another embodiment as it would be taken along the line VI — VI of FIG. 5.
Figure 7:
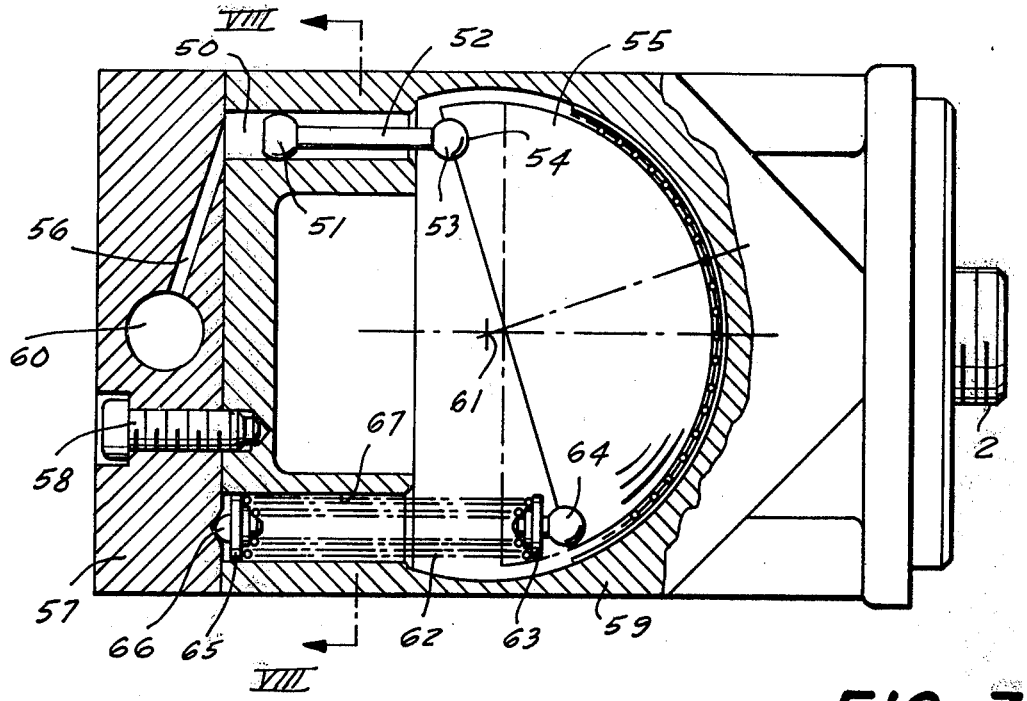
FIGS. 7 and 8 are views similar to FIGS. 5 and 6 showing still another embodiment of an axial-piston machine according to the invention.
Figure 8:
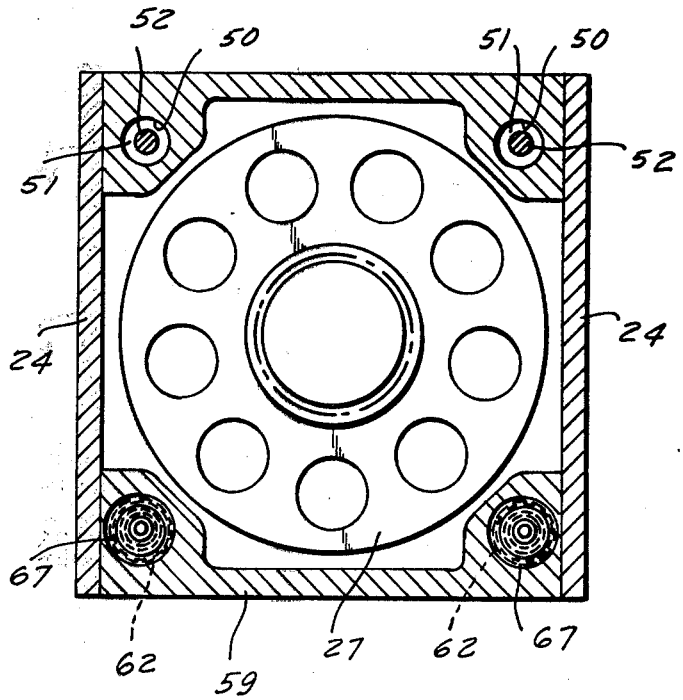

The embodiment of FIG. 6 uses the same pistons 42 as has been described in connection with the embodiment of FIG. 5, although the setting cylinders are of the configuration of those of FIG. 4. In each of the embodiments of FIGS. 1 through 6, four setting cylinders are preferably provided at the vertices of a square. However, in the embodiment of FIGS. 7 and 8, only two setting cylinders 50 are provided. In each of these setting cylinders 50, a ball-shaped control piston 51 is shiftable by hydraulic fluid and is connected by a piston rod 52 with a ball head 53 held in a ball seat 54 of the rocker 55. The setting cylinders 50 are connected by bores 56 in the housing bottom 57 which is held against the cylinder housing 59 by bolts 58. Hydraulic fluid under pressure is supplied to the bores 56 from the working fluid passage 60.

While the two control pistons 51 are effective at one side of the tilting axis 61 of the rocker 55, the opposite side of the rocker is engaged by two control springs 62 which bear against spring plates 63 whose ball heads 64 are received in ball sockets of the rocker 55. The springs 62 are seated against spring plates 65 which are centered within bores 67 formed in the housing 59. The bores 67 also receive the springs 62. The cylinder drum 27 is rotatable in the housing 59 which can be provided with an appropriate recess to accommodate this cylinder drum. The housing is completed by cover plates 24 as previously described.

In this embodiment, the springs 62 act counter to the hydraulic force in the cylinders 50 and thus to swing the rocker 55 in the counterclockwise sense. When the hydraulic fluid under pressure is applied through the passage 60 and bores 56 to the cylinders 50, the rocker 55 is swung in the clockwise sense, e.g., to the position illustrated in dot-dash lines.

Figure 9:
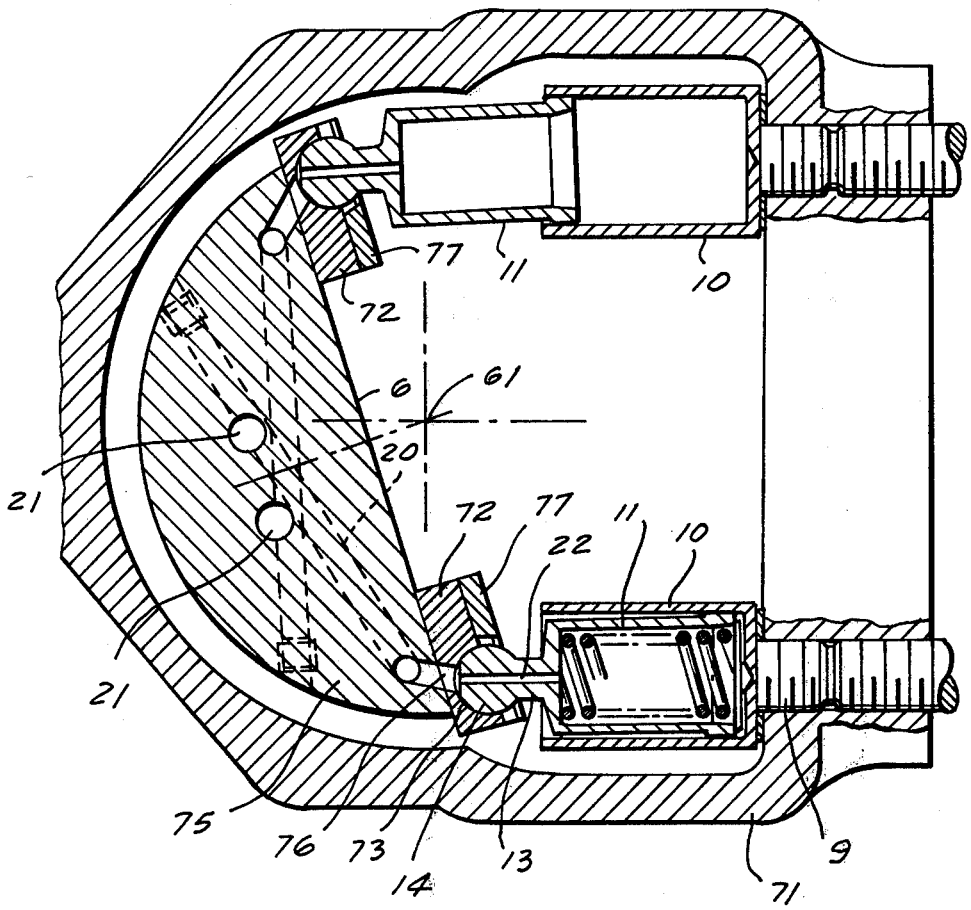
FIG. 9 is a section parallel to the axis of rotation of the cylinder drum of an embodiment in which the setting pistons are articulated to spacer plates according to the invention.

In the embodiment of FIG. 9, the housing 71 corresponds to the housing 1 of FIG. 1 and can be provided with a housing bottom 7 which has not been illustrated. The cylinders 10 have threaded heads 9 received in bores in the housing bottom 7 and the pistons 11 are connected by necks 13 to ball heads 14 provided with bores 22 communicating with the interiors of the cylinders 10 as described in connection with FIG. 1.

In this embodiment, however, the rocker 75 is provided with bores 21 and 20 similar to those of the rocker 5 with the sole distinction that the rocker 75 does not have ball sockets 15. Consequently, the inclined or inclinable surface 6, which forms the control surface for the axial pistons of the drum, carries spacer plates 72 which can be screwed to the surface 6 and in which the sockets 73 are formed to pivotally receive the ball heads 14. The spacer plates 72 are provided with bores 76 which communicate with the bores 20.

The ball heads 14 are held in the respective sockets 73 by respective retaining plates 77 which, in turn, can be bolted onto the spacer plates 72. The surfaces of the retaining plates 77 turned toward the ball heads 14 may be spheroidally concave or conical and can be provided with slots 78 through which the necks 13 extend to facilitate mounting.

Figure 10:
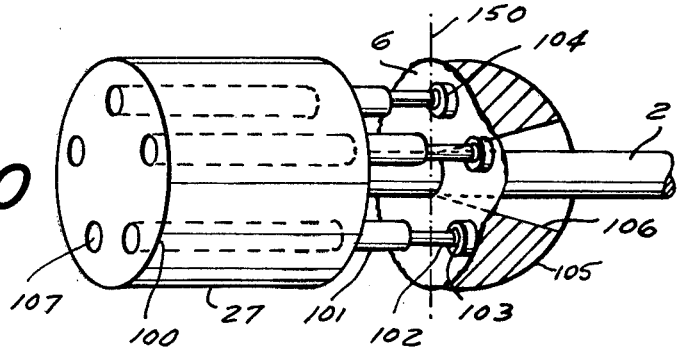
FIG. 10 is a partial perspective view, showing the rocker in section, diagrammatically illustrating the relationship between the drive shaft, the cylinder drum and the rocker for each of the embodiments of FIGS. 1 through 9.

The sliding shoes of the axial pistons of the drum, which engage the surface 6, can be held in place by a retainer in the form of a ring or plate (as shown at 150 in FIG. 10). In this case, the retaining plates 77 can be replaced by the retaining plate which also serves to hold the sliding shoes against the surface 6. Hence the sliding shoes should have a thickness no greater than that of the spacer plates 72. When, however, the thickness of the shoes is greater, i.e., corresponds to the thickness of the spacer plate 72 plus the thickness of the retaining plate 77, the plate holding the slide shoes against the surfaces 6 can be simply screwed to the retaining plate 77.

From FIG. 9 it will be apparent that the socket 73 in the spacer plate 72 can have a greater distance from the pivot axis 61 than sockets which are formed directly in the surface 6.

Referring now to FIG. 10, it will be seen that each cylinder drum 27 can be provided with an array of cylinder bores 100, each of which is provided with the usual piston 101 having a ball head 102 received in a ball socket 103 of a slide shoe 104 which may be held by a plate of the type described against the surface 6 of the rocker 105, the latter representing the rockers shown in all of the embodiments previously described. Each of the rockers may be provided, as has been illustrated for the rocker 105, with a bore 106 through which the shaft 2 can pass with ample clearance to permit tilting of the rocker. The cylinders 100 communicate via ports 107 with hydraulic fluid inlets or outlets formed in the bottom of the housing against which the cylinder 27 bears. The configuration of these ports is conventional in the art and requires no amplification here.

Figure 11:
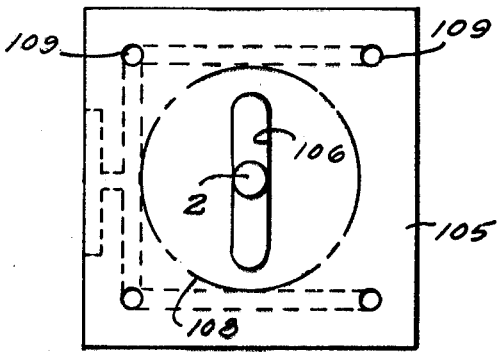
FIG. 11 is an elevational view of the rocker at a side thereof engaged by the pistons of the cylinder drum, illustrating the orbits of the pistons of the cylinder drum.
Figure 12:
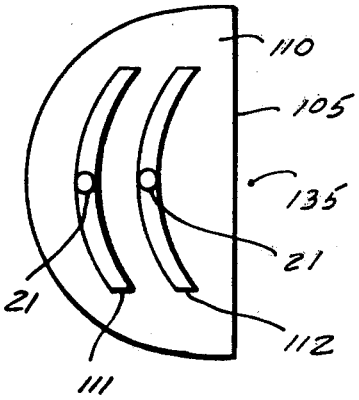
FIG. 12 is a side-elevational view showing the arcuate ports to which hydraulic fluid may be fed and from which fluid may be drained from the setting cylinders according to the embodiments of FIGS. 1 through 6 and FIG. 9.

As has been illustrated in FIG. 11, each rocker 105 with its bore 106 controls the pistons 101 which orbit in a circle represented in dot-dash lines at 108, the ports 109 which are symbolic or representative of the ports communicating with the setting cylinders in the embodiments of FIGS. 1–6 and 9, being disposed at the vertices of a square circumscribing the orbit 108. The ports 21 in each of the embodiments illustrated can open at a lateral face 110 of the rocker 105 as shown in FIG. 12, preferably in arc-segmental grooves 111 and 112. These grooves may be selectively aligned with a discharge port 113 in a slide valve 114 having the additional bores 115 and 116 which supply hydraulic fluid to the grooves 111 and 112. Thus, when port 113 communicates with groove 111 and port 116 with groove 112, hydraulic fluid is trained to the reservoir 117 from groove 111 which hydraulic fluid is fed under pressure from a pump 118 to the groove 112. When the slide valve 114 is shifted to the right, the port 115 communicates with the groove 111 while the port 113 communicates with the groove 112 to reverse the flow of hydraulic fluid to the setting cylinders and thereby reverse the position of the rocker.

Figure 13:
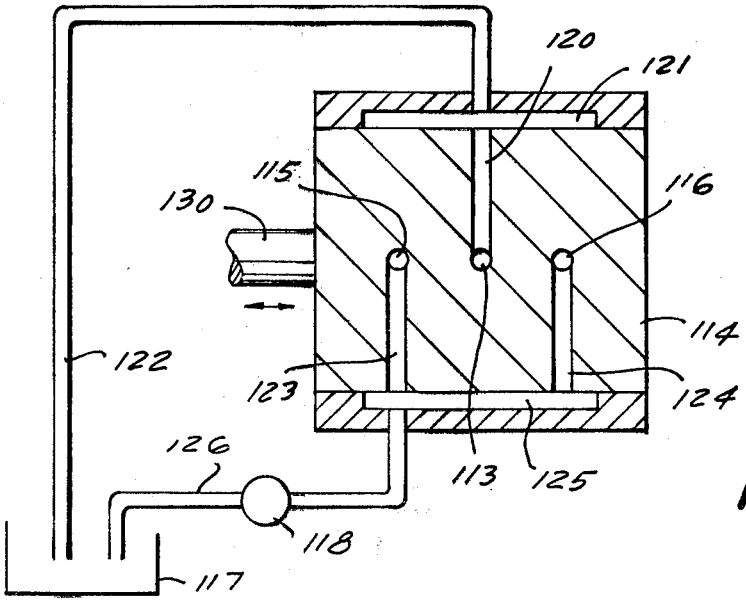
FIG. 13 is a sectional view through a control valve for feeding hydraulic fluid to and removing hydraulic fluid from the ports illustrated in FIG. 12.

The slide valve 114 illustrated in FIG. 13 is merely representative of any valve system which can perform a similar function. Advantageously, the port 113 is connected by a passage 120 to a chamber 121 communicating via line 122 with the reservoir 117. Similarly, the ports 115 and 116 communicate via passages 123 and 124 with a chamber 125 connected by line 126 to the pressure side of the pump 118. An actuator for the slide 114 can be the rod represented at 130, the latter being displaced by a servomechanism not shown or by hand. The arc segmental grooves 111 and 112 have centers of curvature on the pivot axis 135 of the rocker 105 so that they remain in registry with the ports 115 and 113 or 113 and 116 in all angular positions of the rocker 105 once the valve 114 has been positioned to supply fluid to one of the grooves and remove fluid from the other.

We claim:

1. An axial-piston machine, comprising:

a housing;

a cylinder-drum member received in said housing and rotatable about a first axis therein, said cylinder-drum member being formed with a plurality of working cylinders each receiving a respective working piston;

a control-surface member engaged by said pistons and having, in a working position of the machine, an inclination to said axis whereby rotation of one of said members relative to said housing displace said working pistons axially in the cylinders of said drum; and tilting means in said housing for angularly displacing one of said members about a tilt axis perpendicular to the said axis of said drum thereby altering the inclination between said control surface member and said axis of said drum, said tilting means including setting elements disposed at four corners of a rectangle closely surrounding and circumscribing said drum as seen in cross section perpendicular to the axis of said drum.

2. The machine defined in claim 1 wherein said control surface member is a rocker provided with a generally square control surface engaged by the pistons of said drum and said setting elements engage the corners of said rocker.

3. The machine defined in claim 2 wherein all four setting elements are setting cylinders receiving respective setting pistons.

4. The machine defined in claim 2 wherein two setting elements on one side of said rocker are cylinders receiving respective pistons and two setting elements on the opposite side of said rocker are control springs urging said rocker in a predetermined sense about said tilt axis.

5. The machine defined in claim 2 wherein at least two of said setting elements are setting cylinders articulated to said housing.

6. The machine defined in claim 2 wherein at least two of said elements are setting cylinders each receiving respective setting pistons, said setting pistons engaging said rocker, said setting pistons being formed with spheroidal portions sealingly engaging the wall of said setting cylinders, connecting rods connected to said spheroidal portions, and respective ball heads acting upon said rocker through respective sockets.

7. The machine defined in claim 6 wherein said sockets are formed in slide shoes bearing against said control surface of said rocker.

8. The machine defined in claim 6 wherein each of said sockets is formed in a spacer plate engaging said rocker.

9. The machine defined in claim 8 wherein each spacer plate is secured to aid rocker such that the respective socket lies outwardly of the outline of said rocker.

10. The machine defined in claim 2 wherein each of said elements is a setting cylinder, said cylinders being individually mounted in said housing and receiving respective setting pistons bearing upon said rocker, said housing having a square profile.

11. The machine defined in claim 2 wherein all of said setting elements are setting cylinders formed directly in said housing and receiving respective setting pistons, said housing having a square profile.

12. An axial-piston machine, comprising:

a housing;

a cylinder-drum member received in said housing and rotatable about a first axis therein, said cylinder-drum member being formed with a plurality of working cylinders each receiving a respective working piston;

a control-surface member engaged by said pistons and having, in a working position of the machine, an inclination to said axis whereby rotation of one of said members relative to said housing displaces said working pistons axially in the cylinders of said drum; and tilting means in said housing for angularly displacing one of said members about a tilt axis perpendicular to the said axis of said drum thereby altering the inclination between said control surface member and said axis of said drum, said tilting means including setting elements disposed at four corners of a rectangle closely surrounding said drum as seen in cross section perpendicular to the axis of said drum, said control surface member being a rocker provided with a generally square control surface engaged by the pistons of said drum, said setting elements engaging the corners of said rocker, at least two of said setting cylinders are provided with threads threadingly engaging said housing for adjustment of the axial spacing of said setting cylinders from said rocker, respective springs received in said two setting cylinders, and respective setting pistons engaged by said springs and bearing against said rocker.

13. The machine defined in claim 12 wherein each of said setting cylinders is formed externally along a portion of its length with a hexagonal profile and said housing is provided with a cover removable to afford access to the respective settting cylinders, said cover locking against said hexagonal profile to prevent rotation of the setting cylinder.

14. An axial-piston machine, comprising:

a housing;

a cylinder-drum member received in said housing and rotatable about a first axis therein, said cylinder-drum member being formed with a plurality of working cylinders each receiving a respective working piston;

a control-surface member engaged by said pistons and having, in a working position of the machine, an inclination to said axis whereby rotation of one of said members relative to said housing displaces said working pistons axially in the cylinders of said drum; and tilting means in said housing for angularly displacing one of said members about a tilt axis perpendicular to the said axis of said drum thereby altering the inclination between said control surface member and said axis of said drum, said tilting means including setting elements disposed at four corners of a rectangle closely surrounding said drum as seen in cross section perpendicular to the axis of said drum, said control surface member being a rocker provided with a generally square control surface engaged by the pistons of said drum, said setting elements engaging the corners of said rocker, said elements including at least two setting cylinders each receiving a respective setting piston, said setting piston engaging said rocker, said rocker being formed with passages for feeding hydraulic fluid to said setting cylinders through said setting pistons.

15. An axial-piston machine, comprising:

a housing;

a cylinder-drum member received in said housing and rotatable about a first axis therein, said cylinder-drum member being formed with a plurality of working cylinders each receiving a respective working piston;

a control-surface member engaged by said pistons and having, in a working position of the machine, an inclination to said axis whereby rotation of one of said members relative to said housing displaces said working pistons axially in the cylinders of said drum; and tilting means in said housing for angularly displacing one of said members about a tilt axis perpendicular to the said axis of said drum thereby altering the inclination between said control surface member and said axis of said drum, said tilting means including setting elements disposed at four corners of a rectangle closely surrounding said drum as seen in cross section perpendicular to the axis of said drum, said control surface member being a rocker provided with a generally square control surface engaged by the pistons of said drum, said setting elements engaging the corners of said rocker, at least two of said elements being setting cylinders each receiving respective setting pistions, said setting pistons engaging said rocker, said setting pistons being formed with spheroidal portions sealingly engaging the wall of said setting cylinders, connecting rods connected to said spheroidal portions, and respective ball heads acting upon said rocker through respective sockets, each of said sockets being formed in a spacer plate engaging said rocker, said spacer plate having a thickness corresponding to the distance of a retainer for shoes of said working pistons from said control surface.

* * * * *